US006802759B1

(12) United States Patent
Melkert

(10) Patent No.: US 6,802,759 B1
(45) Date of Patent: Oct. 12, 2004

(54) GRINDER

(75) Inventor: Sjaak Melkert, Baindt-Schachen (DE)

(73) Assignee: Voith Paper Holding GmbH, Heidenheim (DE)

( * ) Notice: Subject to any disclaimer, the term of this patent is extended or adjusted under 35 U.S.C. 154(b) by 0 days.

(21) Appl. No.: 10/169,263

(22) PCT Filed: Dec. 31, 1999

(86) PCT No.: PCT/EP99/10485

§ 371 (c)(1),
(2), (4) Date: Jun. 28, 2002

(87) PCT Pub. No.: WO01/49451

PCT Pub. Date: Jul. 12, 2001

(51) Int. Cl.[7] ..... B24B 5/37
(52) U.S. Cl. ..... 451/5; 451/425; 451/49
(58) Field of Search ..... 451/5, 56, 303, 451/304, 307, 425, 49, 548, 160

(56) References Cited

U.S. PATENT DOCUMENTS 5,042,205 A * 8/1991 Girard et al. ..... 451/6
5,315,789 A * 5/1994 Takashi ..... 451/5
5,386,665 A * 2/1995 Heim ..... 451/5
5,394,653 A * 3/1995 Maier ..... 451/303
5,954,565 A * 9/1999 Mori et al. ..... 451/5
6,306,007 B1 * 10/2001 Mori et al. ..... 451/5

FOREIGN PATENT DOCUMENTS

| | | | |
|---|---|---|---|
| WO | WO 93/08235 | 2/1993 | ..... 21/2 |
| WO | WO 97/31755 | 9/1997 | ..... 5/307 |
| WO | WO 98/03304 | 1/1998 | ..... 5/36 |

* cited by examiner

*Primary Examiner*—Lee D. Wilson
(74) *Attorney, Agent, or Firm*—Taylor & Aust, P.C.

(57) ABSTRACT

A grinder for grinding an outer surface of a roll, in particular one of a tissue cylinder and a machine glazed cylinder, the roll having an axis, including a grinding mechanism displaceable in a direction substantially parallel to the axis of the roll, the grinder mechanism also displaceable toward and away from the axis and a measuring system associated and displaceable with the grinding mechanism, the measuring system measuring the position of the grinding mechanism relative to the roll and relative to at least one reference line that is outside of the roll, the grinding mechanism being adjustable substantially parallel to the axis. The measuring system obtaining measurement values, the measurement values being used to positionally control the grinding mechanism.

12 Claims, 3 Drawing Sheets

GRINDER

BACKGROUND OF THE INVENTION

1. Field of the Invention

The present invention relates to a grinder for grinding an outer surface of a roll, such as a paper machine roll, in particular a tissue cylinder or a machine glazed cylinder.

2. Description of the Related Art

Cylinders having a smooth surface must be reground from time to time. Hitherto roll grinding machines or so-called profile grinding machines have been used to grind great tissue (yankee) or machine glazed cylinders. Such profile or tangential grinding machines grind a smooth contour while traversing the rotating cylinder. However, profile machines of this kind weigh in excess of 4 tons, causing transport and space problems. Profile or tangential grinding is much more involved than a polishing procedure which is used to remove smaller surface damage and roughness. Furthermore, the use of profile grinding machines require considerable reinstallation work. Profile or tangential grinding machines, which are used to recondition great tissue (yankee) or machine glazed cylinders, are of the form of large bench type grinders that have to be installed, leading to the following disadvantages:

- heavy and bulky to ship around the world
- long transport routes due to sea freight
- take a relative long time to install and prepare the equipment underneath the cylinder
- major paper machine components must be removed and reinstalled to allow space for the grinder.

Polish grinding machines, are used for polishing, having lower transport costs and require less installation and dismounting time than grinding machines. Such polish grinding machines are small and have a weight of about 0.5 tons. Polish grinding machines are usually embodied by belt or band grinding machines as disclosed in WO 9803304 and WO 9302835. Machines of this kind provide a sufficiently great power but are not used to change the contour of the cylinder. They are limited to compensating for scratches, markings and the like. Band grinding machines are mounted on the scraping blade holder of the cylinder and can, without greater expenditure, be laid out for traversing along the cylinder.

A disadvantage of polish grinding machines is that they do not influence the contour or the concentricity of the cylinder and are pneumatically pressed against the cylinder with constant pressure. In contrast to profile grinding machines, where a reference is given by the machine bed or by a physical reference plane on the grinding machine, polish grinding machines are not provided with such a reference. In particular, the scraper blade cannot be used as a reference when, the contour or the concentricity of the cylinder is to be reestablished.

SUMMARY OF THE INVENTION

The present invention provides a grinder having the basic structure of the polish grinding machine as disclosed in WO 9803304 and WO 9302835, but by which profile grinding can also be carried out.

A measuring system associated and displaceable with the grinding mechanism is provided for determining the position of the displaceable grinding mechanism relative to the roll and relative to at least one reference line provided outside of the roll. The system and mechanism is adjusted parallel to the axis of the roll, with the relative position being determined in a plane, preferably perpendicular to the reference line. The grinding effected by the grinding mechanism is controlled on the basis of the measurement values obtained from the measuring system.

With a virtual reference a corresponding control of the application force or contact pressure force of the polish grinding or profile grinding machine is possible. Even if the grinder is used for profile grinding, due to the virtual reference that is provided, the basic structure can principally be the same as with a usual polish grinding machine, such as a polish grinding machine disclosed in WO 9803304 and WO 9302835, the disclosures of which are hereby incorporated herein by reference. The measuring system is preferably a laser measuring system.

In accordance with a further embodiment of the present invention at least one reference line is provided as a wire spanned parallel to the axis of the roll. In practice, the grinding mechanism is preferably controlled so that only elevations are removed.

When at least two parallel reference lines are provided, the measuring system can additionally be laid out for determining the inclination of the grinding mechanism in a plane perpendicular to the reference lines and/or for determining the angular position of the roll. The measuring system may include a triangular path measuring device, for carrying out measurements by triangulation.

In accordance with another embodiment of the present invention, the measuring system determines the outer surface contour of the roll. The grinder can be controlled so that measurement and grinding cycles are executed in parallel or alternately. However, it is preferred to control the grinder so that measurement and grinding cycles are executed alternately. The grinding mechanism itself is preferably a band grinding mechanism.

According to yet another embodiment of the present invention the grinder is controlled for profile grinding. The grinding mechanism is mounted on a scraper blade holder associated with the roll or on a rail temporarily replacing the scraper blade, and displaceable along the scraper blade and rail, respectively.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
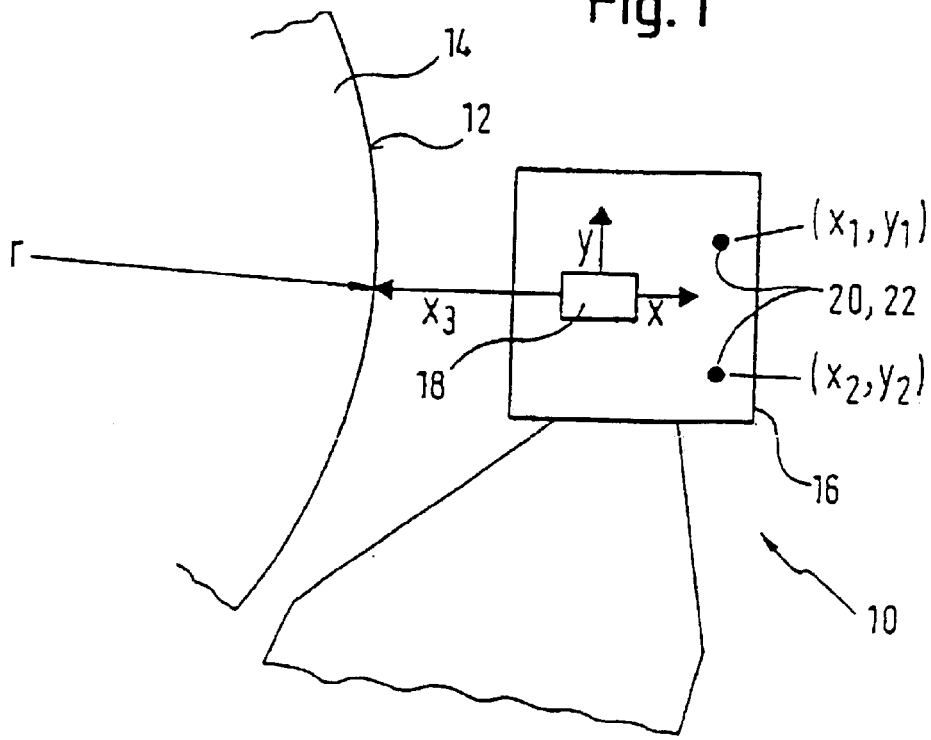
FIG. 1 schematically illustrates an embodiment of a measuring principle which is used for the measurement system of a grinder of the present invention.
Figure 2:
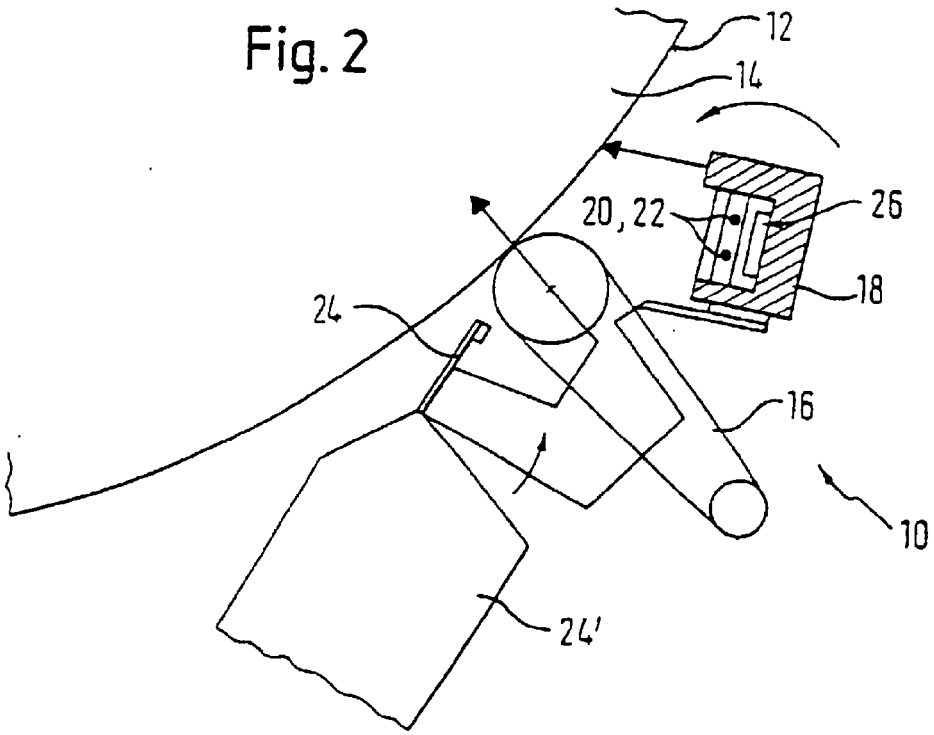
FIG. 2 is a schematic sideview of an embodiment of a grinder of the present invention including a band grinding mechanism mounted on a scraper blade holder associated with the roll and displaceable along the blade.

Referring now to the drawings, and more particularly to FIGS. 1 and 2, there is shown a grinder 10 for grinding an outer surface 12 of a roll 14, such as paper machine roll 14, in particular a tissue (yankee) cylinder 14 or machine glazed cylinder 14.

Grinder 10 includes a grinding mechanism 16 displaceable in a direction essentially parallel to roll 14 and displaceable towards and away from roll 14 in a direction perpendicular to the roll axis.

Measuring system 18, associated and displaceable with grinding mechanism 16, determines the position of displaceable grinding mechanism 16 relative to roll 14 and relative to at least one reference line 20 or 22, which are outside of said roll 14 and are adjusted parallel to the axis of roll 14. The relative position is determined in a plane perpendicular to at least one reference line 20 or 22. The grinding effected by grinding mechanism 16 is controlled on the basis of the measurement values obtained from measuring system 18. Measuring system 18 is mounted on grinding mechanism 16, and is preferably a laser measuring system.

According to one embodiment of the present invention, at least one reference line 20 or 22 is a wire spanned parallel to the axis of roll 14. Grinding mechanism 16 is preferably controlled so that only elevations are removed. When using at least two parallel reference lines 20 and 22 measuring system 18 can additionally be laid out for determining the inclination of grinding mechanism 16 in a plane that is perpendicular to reference lines 20 and 22 and/or for determining the angular position of roll 14.

Measuring system 18 may be a triangular path measuring device. Measuring device 18 is used for determining the outer surface contour of roll 14. Principally, grinder 10 can be controlled so that measurement and grinding cycles are executed in a parallel or an alternate manner. However, it is preferred to control grinder 10 such that measurement and grinding cycles are executed alternately.

As illustrated in FIG. 2, grinding mechanism 16 is a band grinding mechanism 16. Grinding mechanism 16 can be mounted on a curved or bent scraper blade holder 24 and/or an associated scraper beam 24'. Alternatively, grinding mechanism 16 can be mounted on a rail temporarily replacing scraper blade 24. Mounted grinding mechanism 16 is displaceable along scraper blade 24 and rail, respectively. Thus, the mounting of grinder 10 can be similar to that of a polish grinding machine as disclosed in WO 9803304 and WO 9302835. However, with the provided virtual reference grinder 10 can be used for profile or tangential grinding. In doing so, grinding mechanism 16 is controlled in such a way that only elevations are removed.

In FIG. 1, $x_1$, $y_1$ and $X_2$, $Y_2$ are the coordinates of two adjusted wires 20 and 22 relative to measuring system 18 and $X_3$ is the distance between measuring system 18 and outer surface 12 of roll 14 having radius r. In FIG. 2, the respective laser beams generated by measuring system 18 are indicated by 26. Roll 14 can, for example, be a yankee cylinder. Radius r itself can be determined by the following function:

$$r=f(x_{1,2,3}, y_{1,2}, C),$$

wherein "C" are calibrated parameters (wire position etc.). As already mentioned, measuring system 18 may include a triangular path measuring device. A 2D scanning device may also be provided.

Alternatively, a conventional polish grinding machine can be provided with the necessary hardware and software so that such a polish grinding machine can also be utilized for profile or tangential grinding.

The information on how much the roll surface topography deviates from the measured target crown line is processed in such a way as to eliminate deviation by a corresponding control of the force and/or pressure applied by the wheel heads of grinding mechanism 16.

The functional structure of the total system is as follows:

Measuring System

- Systems for topography measurement and positioning
- Calibration of the required measurement standards
- Accuracy analysis Control System

- Calculation of the machining allowance
- Synchronization of kinematic sequences
- Exact control in cross direction
- Grinding force control of both wheelheads according to default criteria
- Consideration of special states
- Determination of the abrasive characteristics such as a grinding curve that is experimentally obtained.

Attachment Modification

- Auxiliary driven axes for grinding force control
- Synchronization attachment

The measuring system can be laid out for recording the crown or crowning line topography of the roll 14 or yankee cylinder consisting, for example, of the following components:

1. a measuring system for determining the angular position of roll 14;
2. a measuring system for finding out the position along a cross direction cd;
3. adjustment of the at least one spanned wire,
4. a measuring device for determining the radial distance between the at least one spanned wire and the crown line surface; and
5. a control processor (PC) for calculating the crown line topography.

Components 1 and 2 are used to determine the current local co-ordinates on the crown line of roll 14 during the rotation of roll 14 thereby simultaneously moving measuring equipment 18 in cross direction cd. To define the angular position, a self-adhesive incremental measuring band with reference marks is provided on the circumference of roll 14. Alternatively, a frictional wheel path sensor and a reference mark can be provided on roll 14. The position in cross direction cd is measured by a control path sensor. The current local coordinates, which are thereby obtained, are necessary to generate a measuring grid for topography as well as to determine the grinding position.

The installation of the span-wire(s) including one or more wires 20 and 22, spanned equidistantly from the axis of roll 14 serves as the reference to the roll axis, which is not accessible for measurement. The adjustment of span-wire(s) 20 and/or 22 establishes the measuring base for the determination of position-related radii differences on the crown line of roll 14. The use of such a virtual reference takes into account the fact that the mechanical guidance of the distance measuring units cannot act as a base to achieve the required accuracy. The current position of the distance measuring unit inside the section plane of roll 14 is determined by way of span-wire(s) 20 and/or 22, which include one or more axially spanned wires.

Two orthogonal positions, as well as the angular location of measuring device 18 relative to the normal line in the measuring point on the crown line are required. The angular position is determined by way of an electronic inclinometer. Alternatively, the angular position can be determined by way of two reference lines, such as two wires spanned in parallel. The distance measuring unit includes:

- a laser scanning system for determining the location and inclination of measuring system 18 in the cross section plane of roll 14 (if only one spanned wire is used, an inclinometer may be used to measure the inclination),
- a laser triangulation path measuring instrument for determining the distance to surface 12 of roll 14, and
- a platform to fix the above-mentioned components in a fixed manner.

The distance measuring unit is not guided in cross direction cd on its own. It is mounted on abrasive unit 16 equipped with a feed drive in a mechanically reliable way.

In control processor PC the current radii differences of the crown line of roll 14 are calculated from the current measured values and from known parameters of the wire suspension as well as the adjustment geometry that is saved in conjunction with the local coordinates. The parameters on the wire suspension and installation geometry are input into the PC off-line. When coordinating roll speed, feedrate and CPU time, the roll crown line's topography is recorded in a predefined grid on a helix, spanning the whole crown line of roll 14.

On the yankee there are no doctors that are precisely adjusted equidistant to the yankee axis, which could be used as measuring bases to determine the crown line profile. Thus, the real problem in the measurement of the crown line's topography (profile) is to realize a sufficiently precise measuring base. Under the given circumstances of the yankee, the measuring base is provided by at least one reference line, preferably at least one spanned wire, although a laser beam could also be used. One of the advantages of the use of at least one spanned wire is that it can be adjusted to the roll (yankee cylinder) axis and mounted at the crown line's base and end, whereas a laser beam can only be adjusted and fixed at one end of the crown line of roll 14.

To measure the topography of the entire yankee cylinder by way of the distance measuring unit, i.e. measuring system 18, the topography must be traversable by the abrasive attachment in cross direction cd by an exactly defined path value. Therefore, no special axis is necessary. It can also be traversed manually from stop to stop.

In order to put the measuring system into operation, the following steps are provided:

1. mount grinding attachment 16 in conjunction with distance measuring unit 18 on scraper blade 24 and/or holder 24',
2. fix holders and chucks for adjusting span-wires 20 and 22,
3. calculate the mean crown line radii of the yankee from circumference measurements,
4. span and adjust wires 20 and 22, and
5. radially adjust the laser triangulation measuring device or instruments.

The following measuring aids are used for the initiation:

- a nonius band chain for measuring the roll diameter,
- a leveling device for horizontally adjusting spanned wires 20 and 22.

The local radius of the yankee cylinder cannot be measured immediately. Only the radial distance to a straight reference line, such as spanned wires 20 and 22, located equidistantly to the yankee cylinder axis can be measured. In the span-wire measuring technique, a map of the wires, silhouetted with contour lines, can be created by a measuring microscope and evaluated afterwards.

For an automated silhouette measurement, a mapping lens with telecentric beam path is used. Spanned wires 20 and 22, in the telecentering region of the lenses, are illuminated by a light source and the silhouette is mapped into a diode line. Afterwards, the wire diameter, the centroidal position of wires 20 and 22 and the location of wire 20 or 22 in the object field can be evaluated.

Using a scanning method, parallel laser beam 26 with a small beam section is moved over the issue to be measured. A laser beam is deflected over rotating mirror surfaces located in the focus of lenses or concave mirrors. During rotation of the mirror, the beam is shifted in parallel over a scanning field and is received on the counter side by a receiver.

The location of wires 20 or 22 in the object field is necessary for this application. This application can also be obtained by several methods, such as suspension control and definition of position. The scanning method provides higher accuracy and lower measurement uncertainties by obtaining multiple measurements and averaging those measurements. For reasons of accuracy and also technical suppositions, the scanning method is used to record the wire position. For scanning the yankee cylinder surface, many instruments or devices for distance measurement are available, such as incremental distance sensors, displacement transducers, inductive probes, eddy current sensors and optical sensors.

Non-contact procedures, especially triangulation sensors based on optical principles provide a suitable solution. A triangulation sensor can be described as follows: A ray of light (preferably a laser beam) is incident at a defined angle on the crown line of the yankee cylinder. The luminous spot is mapped on a receiver at changed positions depending on the corresponding distance of the sensor. A position shift is received by analog photo receivers such as sensors which are sensitive to position, or digital sensors such as photodiode lines in a CCD device.

Span-wires 20 and 22 are adjusted substantially equidistant to the yankee cylinder axis. Therefore, the radial distances from the beginning of the wire and the wire end are adjusted to the yankee cylinder axis and both wire ends are horizontally aligned. The radial distance between span-wire 20 and/or 22 and the yankee cylinder axis is adjusted by two measurable radial distances, located near the front side and the rear front of the yankee cylinder. Therefore the yankee cylinder diameter at both of those adjustment points must be known. The measurement of the mean yankee cylinder diameter at both adjustment points is obtained by a nonius steel band measurement device to determine the circumference of the yankee cylinder. The mean yankee cylinder radius is calculated from the measured circumference. From this value, the radial distances to the crown line of the yankee cylinder at the adjustment points are determined. The adjustment points are then adjusted based on the radial distance determination.

Figure 3:
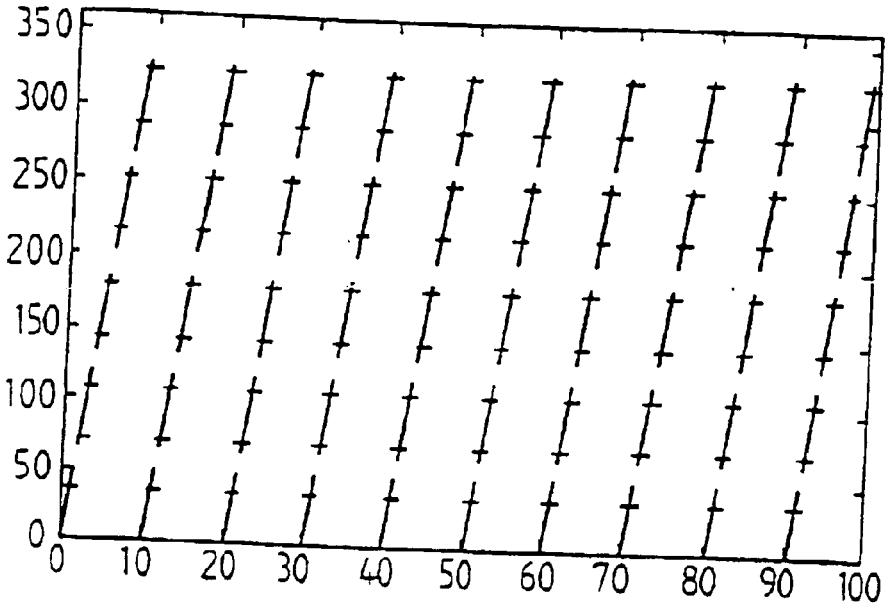
FIG. 3 illustrates a measuring trace for a measuring cycle, of the grinder of FIG. 2.
Figure 4:
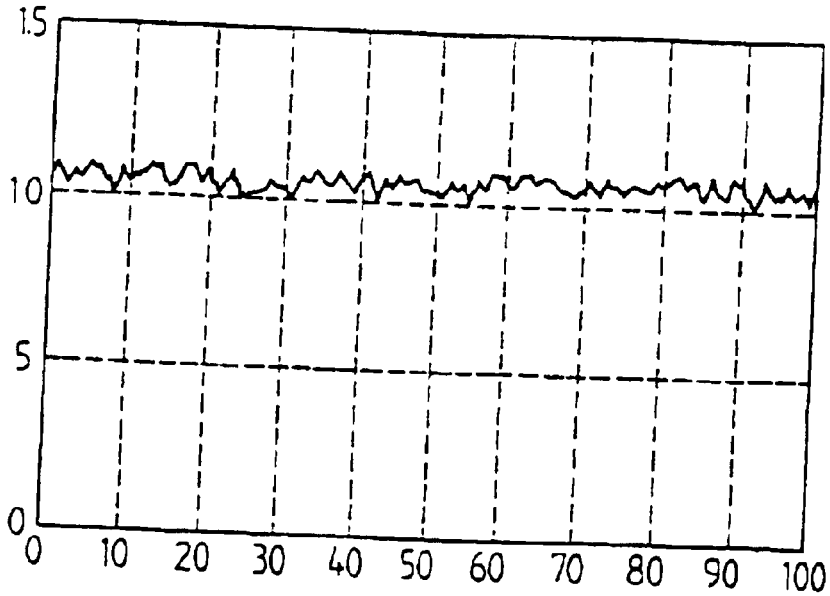
FIG. 4 illustrates typical measuring results obtained by the grinder of FIG. 2 along a measuring trace of FIG. 3.
Figure 5:
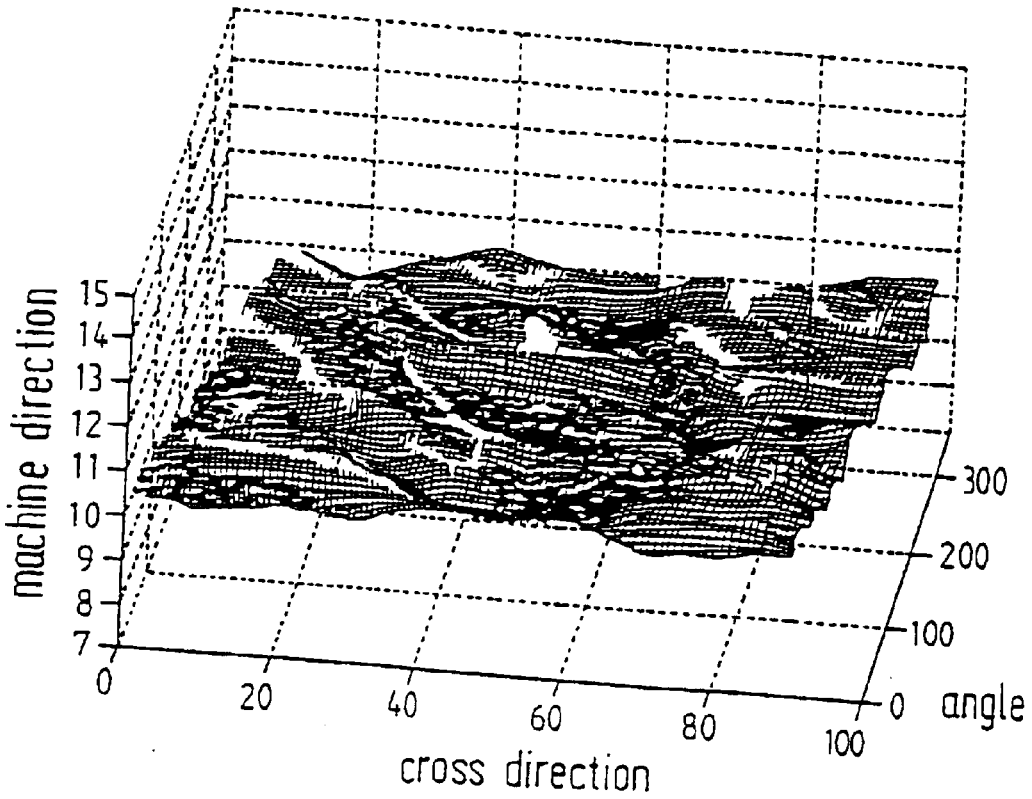
FIG. 5 shows the surface topography representation of the roll of FIGS. 1–4, visualized by interpolation.

All calculations are based on consecutively executed measuring cycles. The measuring values (cd, angle, machine direction md) are recorded on a predefined helical trajectory keeping defined angular distances. The measuring trace results of an exemplary measuring cycle are illustrated in FIG. 3. The measuring results, in a simplified manner, are illustrated in FIG. 4. The surface representation can be visualized by interpolation as shown in FIG. 5.

Grinding by way of the polish grinding apparatus 10 is performed as follows: During grinding, a material height, which can be derived from the grinding force of the grinding curve, is homogeneously removed over the whole width of the abrasive band (grinding band). The grinding force is determined in such a way as to remove as much material as possible without reaching a lower tolerance.

Optimization of the grinding cycle is based on the grinding trajectories, which are precisely tracked since the grinding force to be specifically realized is calculated beforehand. Optimization is separately performed for each angular, cylinder position referencing the same grid as is used in the measuring cycle. The concrete shape of the grinding trajectory is derived therefrom. For each moment of time each grinding head applies grinding force at the points used during measuring—hereunder named as check points. Since each position of the surface is ground repeatedly, a grinding force input acts on several check points.

To reduce the wall thickness of the yankee cylinders as little as possible, no check point is ground below nominal size.

Since a polish grinding is normally performed before the first measuring cycle, in order to achieve an accurate measurement, it may be assumed that only very small gradients appear in the cross direction. Consequently, the residual over-allowance remaining from the optimization approach can be accepted.

The over-allowance can be calculated separately for all angular locations of the yankee cylinder. Solving the optimization problem for each angle demands that the calculations be repeated correspondingly. The required computing and memory capacities are provided by control processor (PC).

The measured values as well as the grinding force are exactly assigned to cd and angle. In general, and especially in the case of necessary interrupts and following a continuation, the reference with the measuring system for cd and angle is re-established.

The additions to a conventional polish grinding machine include the installation of the measuring system, the controlled driving axes and a control processor (PC) to compute and coordinate the measuring and grinding cycles.

Measuring system 18 components, that are integrated into grinding system 10, must be additionally installed. Making use of commercially available components, the smooth interaction with the control processor (PC) is ensured. Measuring system 18 is preferably mounted on polish grinding machine 10 so that it is moved in machine direction md together with grinding machine 16. Controlled driving axes are provided in cross direction cd and machine direction md.

As to the cross direction cd, polish grinding machine 10 is equipped with a drive in cross direction cd which is positioned by controller PC. Controller PC guarantees that the necessary measuring or grinding trajectories are maintained.

As to machine direction md, respective time signals are calculated for the grinding pressure to act adequately on the wheel head. A controlled hydraulic drive can be used to apply pressure. The measuring signal necessary for the controller is fed back as a check value to control processor PC.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE SIGNS

10 grinder
12 outer surface
14 roll
16 grinding mechanism
18 measuring system
20 reference line, spanned wire
22 reference line, spanned wire
24 scraper blade
24' scraper beam

What is claimed is:

1. A grinder for grinding an outer surface of a roll mounted in a paper machine in particular one of a tissue cylinder and a machine glazed cylinder, the roll having an axis, comprising:

a grinding mechanism displaceable in a direction substantially parallel to the axis of the roll, said grinder mechanism also displaceable toward and away from the axis; and a non-contact measuring system associated and displaceable with said grinding mechanism, said measuring system measuring the position of said grinding mechanism relative to the roll and relative to at least one reference line that is outside of the roll, said grinding mechanism being adjustable substantially parallel to the axis, said measuring system obtaining measurement values, said measurement values being used to positionally control said grinding mechanism.

2. The grinder of claim 1, wherein said measuring system is mounted on said grinder mechanism.

3. The grinder of claim 1, wherein said measuring system is a laser measuring system.

4. The grinder of claim 1, wherein said at least one reference line is a wire disposed substantially parallel to the axis of the roll.

5. The grinder of claim 1, wherein said grinding mechanism is controlled to remove elevations from the roll.

6. The grinder of claim 1, wherein said at least one reference line is at least two reference lines, said at least two reference lines being associated with said measuring system, said measuring system being configured to determine at least one of an inclination of said grinding mechanism in a plane substantially perpendicular to said at least two reference lines and the angular position of the roll.

7. The grinder of claim 1, wherein said measuring system further comprises a triangular path measuring device.

8. The grinder of claim 1, wherein said measuring system determines the outer surface contour of the roll.

9. The grinder of claim 1, wherein said measuring system obtains measurements in measurement cycles, said grinding mechanism grinds in grinding cycles, said measurement cycles and said grinding cycles being executed alternately.

10. The grinder of claim 1, wherein said grinding mechanism is a band grinding mechanism.

11. The grinder of claim 1, wherein said grinding mechanism does a profile grinding.

12. The grinder of claim 1, wherein said grinding mechanism is diplaceable along and is mounted on one of a scraper blade holder and a rail that temporarily replaces a scraper blade.

* * * * *